United States Patent [19]

Morrow

[11] Patent Number: 4,494,261

[45] Date of Patent: Jan. 22, 1985

[54] HEAD AND NECK CUSHION

[75] Inventor: Winston G. Morrow, Lake Oswego, Oreg.

[73] Assignee: Spinal Dynamics, Inc., Lake Oswego, Oreg.

[21] Appl. No.: 218,719

[22] Filed: Dec. 22, 1980

[51] Int. Cl.[3] ..... A47G 9/00

[52] U.S. Cl. ..... 5/436; 5/434

[58] Field of Search ..... 5/434–442; D6/201

[56] References Cited

U.S. PATENT DOCUMENTS

| | | | |
|---|---|---|---|
| 2,896,227 | 7/1959 | Reed | 5/437 |
| 3,243,828 | 4/1966 | McCarthy | 5/437 |
| 3,521,310 | 7/1970 | Greenwalt | 5/436 |
| 3,648,308 | 3/1972 | Greenwalt | 5/436 |
| 4,218,792 | 8/1980 | Kogan | 5/436 |
| 4,424,599 | 1/1984 | Hannouche | 5/434 |

FOREIGN PATENT DOCUMENTS

| | | | |
|---|---|---|---|
| 2409326 | 9/1975 | Fed. Rep. of Germany | 5/436 |
| 1941603 | 3/1978 | Fed. Rep. of Germany | 5/435 |
| 2424008 | 4/1979 | France | 5/436 |
| 225934 | 4/1969 | Sweden | 5/434 |

OTHER PUBLICATIONS

Depiction of a Cervical Traction Pillow, Model #P2222.

*Primary Examiner*—Alexander Grosz

*Attorney, Agent, or Firm*—Klarquist, Sparkman, Campbell, Leigh & Whinston

[57] ABSTRACT

A composite head and neck cushion is provided for use by a person in a supine position. The cushion includes a first, resilient member having an upper surface which conforms to and supports the physiologic curvature of the cervical vertebrae. A second member supports the head in a raised, but unflexed position. The invention may alternatively be described as a method for cushioning the head and neck. The method comprises (1) resiliently supporting the back of the neck of the person in an elevated position while permitting the cervical vertebrae to maintain their normal, physiologic curvature, and (2) supporting the head of the person in an elevated position while maintaining the cervical vertebrae and the occiput in an unflexed, physiologic position.

4 Claims, 5 Drawing Figures

HEAD AND NECK CUSHION

BACKGROUND AND SUMMARY OF THE INVENTION

This invention relates to method and means for relieving stress in the neck region of the body, and for promoting proper posture. More specifically, the invention relates to a composite head and neck cushion designed to be placed under the head and neck of a person lying in a supine position.

Viewed from the side, the human spine includes four basic portions, each of which has its own curvature. The uppermost or cervical portion is made up of the cervical vertebrae, and is concave posteriorly. The thoracic portion immediately below the cervical portion is made up of the thoracic vertebrae and is convex posteriorly. The lumbar portion is concave posteriorly and is made up of the lumbar vertebrae. The lowermost or sacral portion of the spine is fixed in position as a result of total fusion of the sacral vertebrae, and is concave posteriorly.

The degree and configuration of the curvature of any of these portions of the spine is interrelated with the curvature of the other portions, all of which are directly affected by pelvic position. The sum of these curves is, in essence, posture. Inheritance, disease, and habit are the three major factors influencing posture. Of these factors, habit is the most pronounced and has the most debilitative effect.

Habitual or prolonged unnatural body position can cause fatigue and strain upon ligaments, and increased muscular demand can cause pain and compensatory postural tension. Moreover, prolonged poor body posture can increase or decrease the range of motion of the vertebrae by stretching or tightening ligaments, thereby effecting muscle activity by accommodation or compensation. Tension, whether emotional, chemical, or physical, affects more often the neck than any other part of the neuromusculo-skeletal system. Tension myalgia of the neck is common, painful, and often disabling.

The neck muscles and ligaments bear the brunt of physical stress. The ligaments, of course, remain the sole support when the muscles are over-powered or fatigued. Ligament strain, where movement is restricted by muscles acting protectively, produces pain from muscle ischemia and from periosteal traction. Ligamentous laxity and aberrant muscle activity alter the integrity of the disc and vertebral segments which can produce degenerative changes. The compressive force of muscular contraction, in the presence of disc degeneration, can result in aberrant neuronal, vascular, and lymphatic alterations predisposing the vertebral joints to arthritic changes and articular insult.

Vertebrae function as motor units with each bony segment being directly dependent upon the integrity of the vertebrae and vertebral discs positioned above and below, as well as the integrity of all tissue which surrounds or offers attachment. Joint receptors of the neck apprise the nervous system of vertebral and head position. Vertebral malposition from ligamentous, muscular, discogenic, or vascular alterations can profoundly affect local and systematic integrity by creating compensatory postural stress.

Since approximately one-third of all human existence is spent in an antigravity position, it has long been the goal of bed and furniture designers to develop furniture for use in supine positions which will support the spine, and the neck vertebrae in particular, in a physiologic position. The term "physiologic" as used herein is intended to define that postural position wherein the parts of the body, particularly the vertebrae of the spine, are in their normal, comfortable, unstressed position, or a position which approximates that of an erect standing individual. Prior art efforts at achieving physiologic posture typically either result in a flattening of the spinal column, or in exaggerating the curvature, thereby resulting in flexion or extension of the vertebrae. The term "flexion" as used herein defines a position in which the head is positioned forwardly and anteriorly of its physiologic position. The term "extension" as used herein defines a position in which the head is positioned rearwardly or posteriorly of its physiologic position.

It is therefore an object of the present invention to develop a head and neck cushion which will support these portions of the body when the user is in a supine position and which will encourage physiologic spinal curvature without resulting in flexion or exaggerated extension of the cervical vertrebrae or of the occiput with respect to the atlas vertebra (C-1). Another object of the invention is to provide a neck pillow for supine use which approximates a physiologic posture in order to remodel the vertebral disc spaces. Yet another object of the invention is to provide a method and means for supporting the head and neck in such a way as to eliminate muscular and ligamentous stresses and thereby relieve aches and pains resulting therefrom.

This invention responds to the problems presented in the prior art by providing a method for cushioning the head and neck of a person in a supine position. The method comprises resiliently supporting the back of the neck of the person in an elevated position while permitting the cervical vertebrae to maintain their normal, physiologic curvature, and supporting the head of the person in an elevated position while maintaining the cervical vertebrae in an unflexed position. The invention may alternatively be defined as a support member for the head and neck of a person lying in a supine position. A first, transversely extending, resilient cushion having a convex upper surface is provided, along with a second, longitudinally extending, resilient cushion mounted to one side of the first cushion, the second cushion including means for supporting the back of the head of the person above the back of the person but below the upper surface of the first cushion, while maintaining the cervical vertebrae and the occiput in an unflexed, physiologic position.

These and other objects, features, and advantages of the present invention will be apparent from the following description, appended claims, and annexed drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 2:
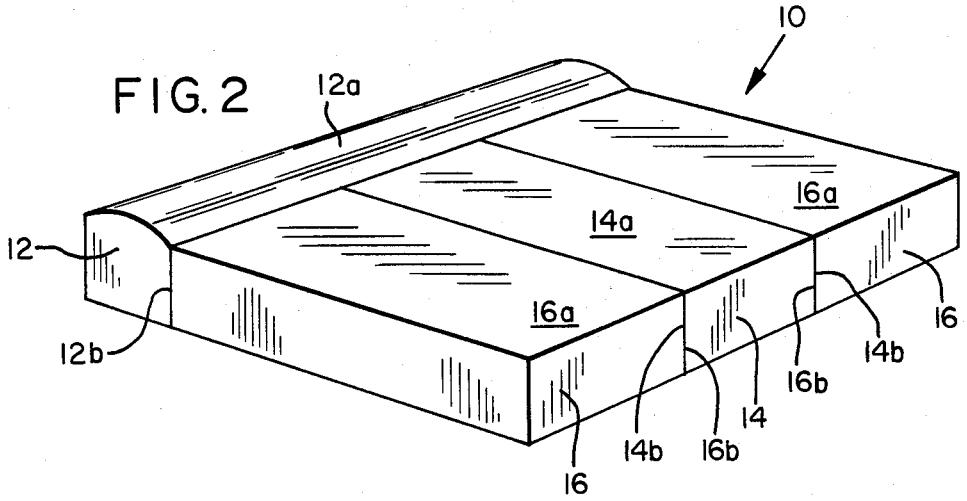
FIG. 2 is a perspective view of one embodiment of the present invention.
Figure 4:
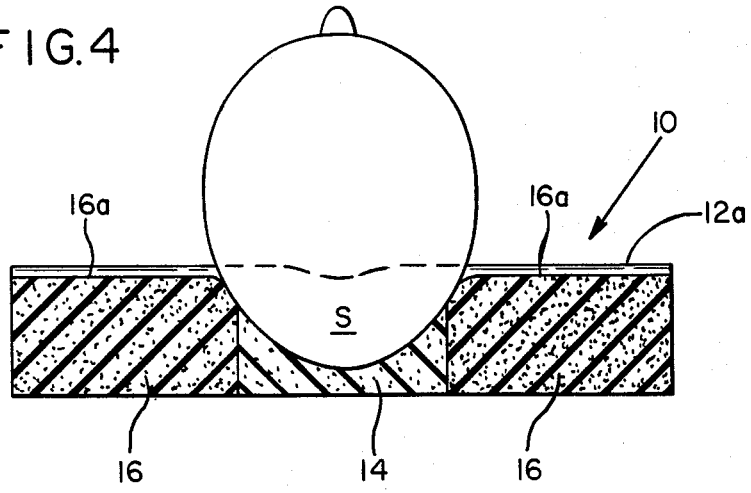
FIG. 4 is an end elevation sectional view taken along 4—4 of FIG. 3.
Figure 3:
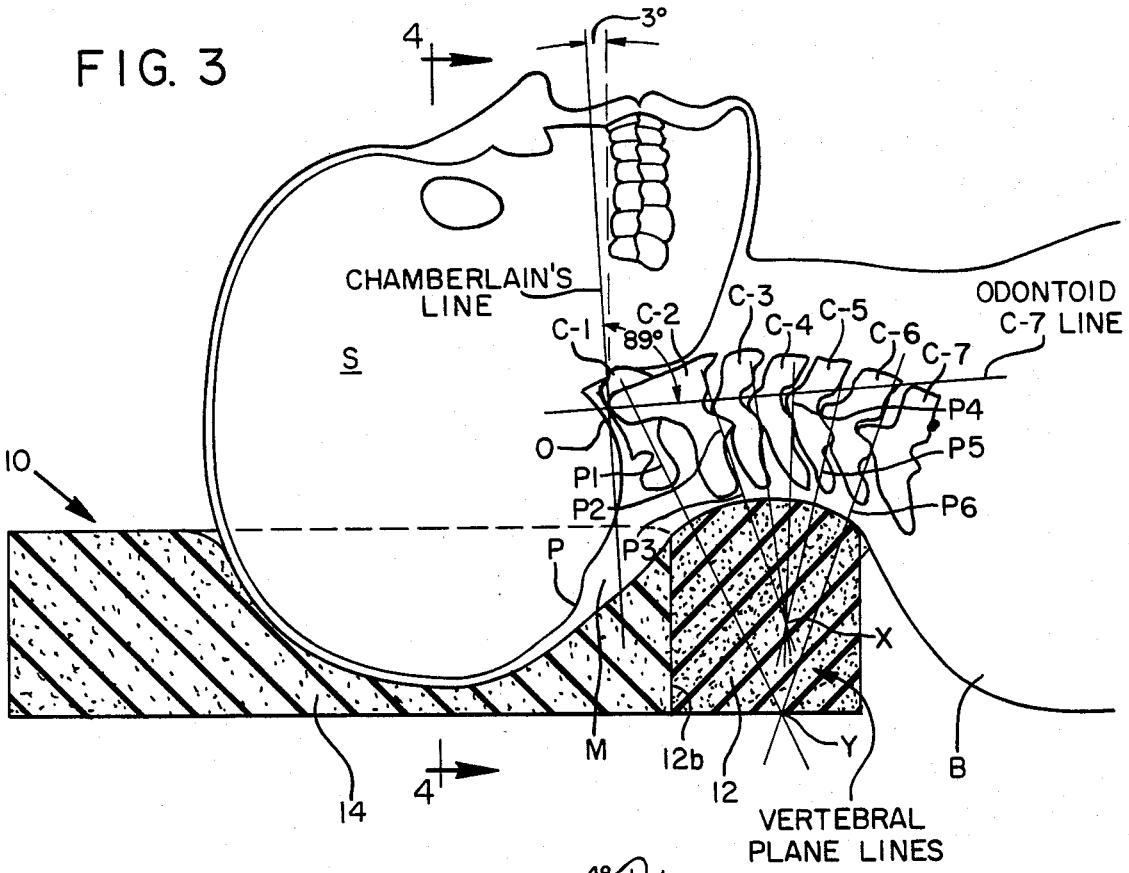
FIG. 3 is a sectional side elevation view of the embodiment of FIG. 2 with a person resting thereon, showing the relative position of the cervical vertebrae and the skull of such person.

The principles of this invention are particularly useful when embodied in a head and neck cushion such as that illustrated in FIGS. 2, 3, and 4, generally indicated by the numeral 10. The depicted head and neck cushion 10 includes a transversely extending resilient member 12, having an upwardly convex or arcuate upper surface 12*a*. As depicted in FIG. 3, the curvature of upper surface 12*a* conforms to the curvature of the cervical vertebrae. The head and neck cushion 10 also has a side surface 12*b* extends downwardly from upper surface 12*a* in a direction perpendicular to the surface upon which cushion 10 is placed.

A longitudinally extending central member 14 is affixed to the central portion of side surface 12*b* of transverse member 12. This central member 14 includes an upper surface 14*a* and a side surface 14*b*. In its normal, uncompressed condition, upper surface 14*a* extends from and is the same height as the side edge of transverse member upper surface 12*a*. As depicted in FIG. 3, the central member 14 is of sufficient length to accommodate the head of the user.

Side members 16 are positioned to each side of central member 14 and are also affixed to side surface 12*b* of transverse member 12. Like the other components, side members 16 include upper surfaces 16*a* and side surfaces 16*b*. As seen in FIG. 2, side surfaces 16*b* are affixed directly to side surfaces.

Transverse member 12, central member 14, and side members 16 are alternatively referred to herein as first, second, third, and fourth cushion means, respectively.

The various members of head and neck cushion 10 are typically affixed to each other through the use of conventional adhesives. The members 12, 14, and 16 are typically formed of polyurethane having different degrees of resiliency. The transverse member 12 is typically the most firm of the members in order to provide adequate support to the cervical vertebrae. It is normally in the range of from 75–85 ILD. ILD is a furniture designer's designation or the resiliency of a particular material. An 80 ILD cushion, for example, exhibits a one inch deflection under an 80 pound load applied over a one square foot area. The resiliency of side members 16 is normally somewhat greater than that of transverse member 12, preferably about 15 ILD. The central member 14 normally has the greatest resiliency, approximating only 10 ILD, thereby providing a soft cushion for the head of the user. However, central member 14 still should have sufficient firmness that it will support the head of the user in a somewhat raised position, as depicted in FIG. 4.

Figure 5:
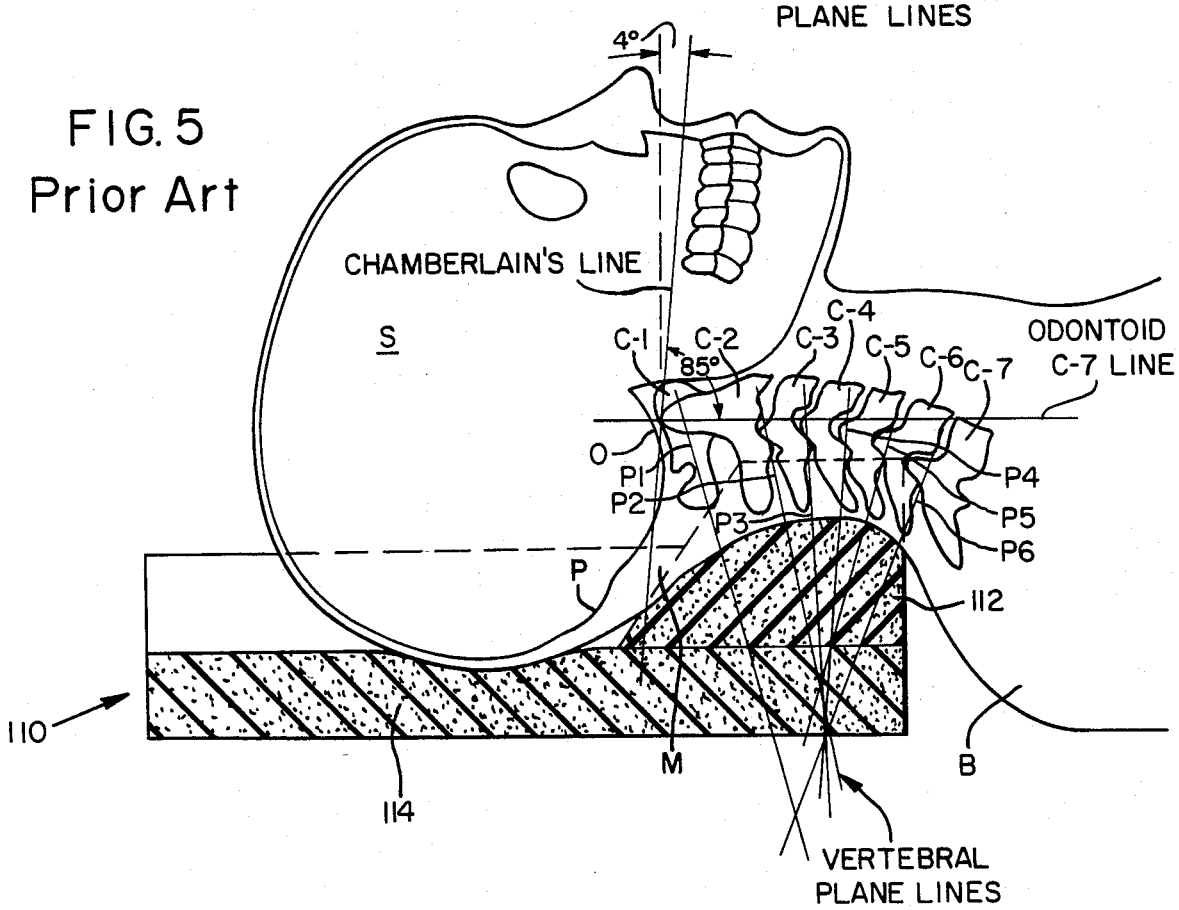
FIG. 5 Prior Art
FIG. 5 is a side elevation sectional view of the prior art cushion depicted in FIG. 1 with a person resting thereon, showing the relative position of the cervical vertebrae and the skull of such person.

The cervical vertebrae are commonly designated C-1 through C-7 and are identified as such in FIGS. 3 and 5. The atlas vertebra, as C-1 is commonly known, contacts the occiput O positioned at the base of the skull S. The term "head" has been used and will continue to be used herein interchangeably with the term "skull".

A close study of FIG. 3 reveals that the cervical vertebrae C-1 through C-7 are maintained by the head and neck cushion 10 in their normal, physiologic lordosis or curvature. The upper surface 12*a* of transverse member 12 is symmetrical, as is the cervical lordosis, and cooperates with the central member 14 to maintain the position of the skull in an elevated position without causing flexion of the occiput O with respect to C-1, or of any other of the cervical vertebrae. Moreover, the height of transverse member 12 is not so great so as to cause flexion or exaggerated extension of the cervical vertebrae C-1 through C-7.

FIG. 3 also shows that the skull S includes an occipital protuberance P adjacent the back or posterior of its base. The size and configuration of the occipital protuberance P varies from person to person. However, head and neck cushion 10 has been designed to accommodate a wide variety of skulls. The cooperation between transverse member 12 and central member 14 is such that central member 14 provides the sole means of support of the skull S; that is, transverse member 12 does not contact the occipital protuberance P, or any other part of the skull S. Also, transverse member 12 does not exert pressure on the substantial ligament and muscle mass M which is proximal to the atlanto-axial-occipital region. This is desirable in order that the occiput O and the upper cervical vertebrae are not forced into a position of flexion.

While central member 14 is normally quite resilient, it still maintains the back of the skull S in a raised position with respect to the back B of the user. As stated previously, central member 14 is typically of substantially greater resiliency than transverse member 12. However, it should be appreciated that it is not necessary that central member 14 be resilient at all. Under certain conditions, it may be desirable to provide a relatively rigid or boardlike central member (not shown). However, such a member should be of appropriate height that the back of the skull S is maintained in an elevated position with respect to the back B of the user.

In the depicted embodiment (see particularly FIG. 4), side members 16 are less resilient than central member 14. Therefore, they may provide a certain amount of support to the lateral aspects of the skull S to prevent inadvertent turning of the skull S. However, it should be appreciated that the central member 14 may be wide enough in certain applications that the side members 16 would not actually contact the centrally-disposed skull S. In fact, it may be desirable to delete side members 16 entirely in certain applications.

It may alternatively be desirable that the two side members 16 be of different resiliency, thereby providing three different degrees of support for the skull; that is, the central member 14 could be of a first degree of resiliency, while the side cushions could exhibit second and third degrees of resiliency. Typical resiliency would be 10 ILD for central member 14, 15 ILD for one of the side members 16 and 20 ILD for the other side member 16. This would increase the versatility of the cushion 10 since it would enable persons with greater or lesser than normal skull weight to use the cushion. Therefore, one of these three members would have a resiliency particularly suited for every individual. The use of three different resiliencies also permits those persons with injured cervical vertebrae to use either of the side cushions during treatment before progressing to the center cushion as the injury is healing.

A comparison between FIGS. 3 and 5 discloses how radically different the present invention is from the prior art. The so-called Kinne prior art cushion is identified with the numeral 110. Similarly, portions of Kinne's cushion which correspond to those of the present invention 10 have been identified with corresponding numerals except that each numeral has been prefixed with the numeral 1. Thus, Kinne's transverse member is identified as 112; his central member is 114; and his side members are designated as 116, with corresponding top and side surfaces being designated with the numerals a and b.

Figure 1:
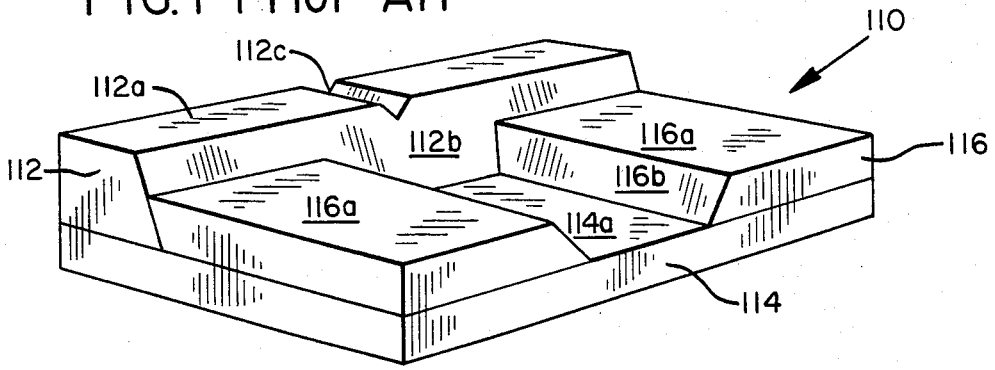
FIG. 1 Prior Art
FIG. 1 is a perspective view of the Kinne prior art cushion.

As shown in FIGS. 1 and 5, the transverse member 112 of head and neck cushion 110 is trapezoidal in shape, with side surface **112*b* inclined at approximately a 45 degree angle. A centrally disposed notch 112*c* is cut into transverse member 112 in order to permit the user to center his or her neck on the head and neck cushion 110. The central member 114 more accurately comprises a depression between side members 116 positioned to each side. The sides 116*b* of side members 116** are inclined at approximately a 45 degree angle.

As seen in FIG. 5, the result of the afore-described configuration is that when the user positions his or her neck on the cushion 110, the upper cervical vertebrae C-1 through C-4 are in flexion both with respect to each other and with respect to occiput O. This is clearly different from the physiologic position made possible by the present invention 10 and depicted in FIG. 3. Moreover, the inclined side surface **112*b* of the transverse member 112 contacts the ligament and muscle mass M adjacent the occipital protuberance P, thereby pivoting the skull in a clockwise direction (in flexion), as shown in FIG. 5 through the use of arrows. Thus, to this extent side surface 112*b* of transverse member 112 provides some support to the head and skull S of the person using cushion 110. An examination of cushion 10 of FIG. 3 illustrates that side surface 12*b* and transverse cushion 12 generally do not force the skull S upwardly and into flexion; rather, all of the support to skull S is provided by central member 14**.

Standard reference lines have also been included in FIGS. 3 and 5 in order to illustrate and emphasize the flexion of the cervical vertebrae C-1 through C-7 and of the occiput O with respect to C-1 in cushion 110. Chamberlain's line is shown in FIGS. 3 and 5, as well as an odontoid C-7 line. Vertical plane lines P-1 through P-6 are also depicted, which extend downwardly from their respective vertebra. Vertebral plane line P-7 has not been depicted due to the difficulty in measuring the position of such line with the person in the depicted, supine position.

As shown in FIG. 3, the position of Chamberlain's line illustrates that the skull S is extended approximately 3 degrees, since Chamberlain's line is normally vertical, or horizontal when the person is standing erect. This has been found to be a particularly desirable position since the neck is less sensitive to slight extension than a corresponding angle in flexion because the range of motion in extension is much greater than that in flexion. An exaggerated position of extension, on the other hand, would be equally undesirable. An exaggerated position of extension may be defined as one wherein Chamberlain's line is extended at an angle of at least 6 degrees with respect to vertical. A position of slight extension is one in which Chamberlain's line extends at less than 6 degrees from vertical.

Described another way, it may be said that Chamberlain's line is slightly inclined upwardly or superiorly or is at least disposed vertically (not inclined downwardly or inferiorly). The odontoid C-7 line forms an angle of approximately 89 degrees with respect to Chamberlain's line. Vertebral plane lines P-1 through P-6 extend in a generally symmetrical pattern, thereby illustrating the symmetrical positioning of vertebrae C-1 through C-6. As illustrated, vertebral plane lines P-2 through P-5 intersect at a common point X, while vertebral plane lines P-1 and P-6 intersect at point Y which substantially corresponds to the lower surface of the cushion 10.

Based upon the position of Chamberlain's line in FIG. 5, Kinne's cushion places the skull S in flexion by approximately 4 degrees. As noted above, the neck is far more sensitive to prolonged flexion than extension; therefore, the position depicted in FIG. 5 is not a very desirable one. The odontoid C-7 line forms an angle of only 85 degrees with respect to Chamberlain's line, thereby further illustrating the flexion promoted by cushion 110. Moreover, the position of vertebral plane lines P-1 through P-6 illustrate the assymmetrical positioning of vertebrae C-1 through C-6. For example, vertebral plane lines P-1 and P-2 are almost parallel, thus demonstrating the high degree of flexion between these vertebrae. Also, the points of intersection of vertebral plane lines P-2 through P-5 are substantially lower than the common point of intersection X shown in FIG. 3 for cushion 10. This further demonstrates the flexion or loss of cervical curvature resulting from use of cushion 110.

Prolonged use of this prior art head and neck cushion 110 may therefore be expected to promote rather than relieve head and neck discomfort. Thus, it can be seen that this prior art cushion 110 is not only dramatically different in structure, but, as a result of such differences, fails to achieve the objects and advantages of the present invention 10.

Of course, it should be understood that various changes and modifications of the preferred embodiments described herein will be apparent to those skilled in the art. Such changes and modifications can be made without departing from the spirit and scope of the present invention and without diminishing its attended advantages. It is, therefore, intended that such changes and modifications be covered by the following claims.

I claim:

1. A pillow for supporting the head and neck of a person lying in a supine position, comprising:

an elongated resilient first pillow member for positioning under and transversely of the neck; and a flat resilient second pillow member affixed along one side of the first pillow member for positioning under the head;

the first pillow member having an upper support surface convexly curved and having a firmness such that the curvature of the neck is induced to conform to the cervical lordosis of a standing person;

the second pillow member having a planar upper surface and a compressibility such that the head is supported at an elevation in which Chamberlain's line is disposed in at least a vertical position;

said one side of the first pillow member meeting the second pillow member at a right angle to said planar upper surface, so that the first pillow member supports the neck without applying pressure lengthwise of the neck to the base of the head, the head being supported by the second pillow member at an elevation determined substantially entirely by the firmness of the second pillow member, the second pillow member comprising at least two coplanar portions affixed side by side along the transverse first pillow member, each portion having a different firmness so that a user can shift the pillow laterally to select one of said portions to support the head, the first pillow member having a uniform cross-sectional shape and firmness along its length to provide a constant measure of support to the neck regardless of lateral position of the pillow under the user's neck and head.

2. A pillow for supporting the head and neck of a person lying in a supine position, comprising:

an elongated resilient first pillow member for positioning under and transversely of the neck; and a flat resilient second pillow member affixed along one side of the first pillow member for positioning under the head;

the first pillow member having an upper support surface convexly curved and having a firmness such that the curvature of the neck is induced to conform to the cervical lordosis of a standing person;

the second pillow member having a planar upper surface and a compressibility such that the head is supported at an elevation in which Chamberlain's line is disposed in at least a vertical position;

said one side of the first pillow member meeting the second pillow member at a right angle to said planar upper surface, so that the first pillow member supports the neck without applying pressure lengthwise of the neck to the base of the head, the head being supported by the second pillow member at an elevation determined substantially entirely by the firmness of the second pillow member, the second pillow member comprising three coplanar portions affixed side by side along said one side of the first pillow member, including a central portion having a firmness substantially less than the firmness of the portions on each side so that the occipital protuberance of the head can sink easily into said central portion.

3. A pillow according to claim 2 in which the central portion of the second pillow member has a firmness of about 10 ILD.

4. A pillow according to claim 3 in which one of the side portions of the second pillow member has a firmness of about 15 ILD and the other of the side portions of the second pillow member has a firmness of about 20 ILD.

* * * * *